United States Patent [19]

Rehman et al.

[11] Patent Number: 5,012,629

[45] Date of Patent: May 7, 1991

[54] METHOD FOR PRODUCING INFUSION COFFEE FILTER PACKS

[75] Inventors: Warren C. Rehman, Flemington, N.J.; Michael E. Delonis, Croton-On-Hudson, N.Y.

[73] Assignee: Kraft General Foods, Inc., Glenview, Ill.

[21] Appl. No.: 419,861

[22] Filed: Oct. 11, 1989

[51] Int. Cl.[5] ..... B65B 47/00

[52] U.S. Cl. ..... 53/453; 206/0.5; 426/394

[58] Field of Search ..... 53/122, 427, 441, 453, 53/454, 464, 559, 560, 578, 579; 206/0.5; 426/394

[56] References Cited

U.S. PATENT DOCUMENTS

| | | | |
|---|---|---|---|
| D. 301,280 | 5/1989 | Craig et al. | D1/102 |
| 2,042,039 | 5/1936 | Cooper | 206/44 |
| 2,087,796 | 7/1937 | Cooper | 99/77.1 |
| 2,377,118 | 5/1945 | Weisman | 426/394 X |
| 2,475,241 | 7/1949 | Hermanson | 206/0.5 |
| 2,603,927 | 7/1952 | Grey | 53/578 X |
| 3,186,139 | 6/1965 | Clauss | 53/559 X |
| 3,192,684 | 7/1965 | Iannucci | 53/579 X |
| 3,218,776 | 11/1965 | Cloud | 53/453 |
| 3,346,388 | 10/1967 | Andrews et al. | 99/77.1 |
| 3,445,237 | 5/1969 | Gidge | 206/0.5 |
| 3,736,722 | 6/1973 | Rosenberg | 53/559 X |
| 3,823,656 | 7/1974 | Vander Veken | 99/295 |
| 3,846,569 | 11/1974 | Kaplan | 426/394 |
| 4,229,481 | 10/1980 | Fornari | 426/77 |
| 4,550,024 | 10/1985 | Le Granse | 426/77 |
| 4,555,894 | 12/1985 | Illy | 53/559 X |
| 4,609,556 | 9/1986 | Goedert | 426/394 |
| 4,746,519 | 5/1988 | Wright et al. | 426/83 |
| 4,817,788 | 4/1989 | Bedenk et al. | 206/0.5 |

*Primary Examiner*—Robert L. Spruill
*Assistant Examiner*—Beth Bianca
*Attorney, Agent, or Firm*—Thomas A. Marcoux; Daniel J. Donovan; Thomas R. Savoie

[57] ABSTRACT

A method is disclosed for producing infusion coffee filter packs in which a first strip of filter paper is placed adjacent to a mold having a cylindrical mold pocket, and the strip of filter paper is caused, either mechanically or by a vacuum, to conform to the cylindrical mold pocket. The conforming step causes the surface area of the first strip of filter paper to stretch and increase by at least three percent relative to its area prior to the conforming step. A measured quantity of ground coffee is then deposited into the mold pocket over the filter paper conformed thereto. A second strip of filter paper is placed over the first strip of filter paper and the ground coffee in the mold pocket. The first and second strips of filter paper are then sealed together around the coffee filled mold pocket, as by a heat sealing press pressing and sealing the strips together. The filter paper is then trimmed as by die cutting to produce a half inch wide flange area extending around the mold pocket. The presence of the one half inch flange in combination with the increased surface area caused by stretching results in a brewed coffee having an increase in soluble solids extraction and a decrease in the standard deviation of soluble solids extraction.

10 Claims, 9 Drawing Sheets

Brew Strength: Pouch vs Loose (SS in Variant/SS when brewed Loose)*100
110
100
90
80
70
5
10
Preparation Level (cups)
Stretch Paper American
Non-Stretch Paper American
Stretch Paper European
Non-Stretch Paper European
Experiment #2
n=4 for loose coffee
n=16 for pouches

METHOD FOR PRODUCING INFUSION COFFEE FILTER PACKS

BACKGROUND OF THE INVENTION

1. Field of the Invention

The present invention relates generally to a method for producing infusion coffee filter packs designed to fit and provide for the consistent brewing of quality coffee in a variety of American and European style coffee brewing appliances. More particularly, the subject invention pertains to a method for producing infusion coffee filter packs designed to be utilized in a variety of different coffee maker appliances, such as American style appliances utilizing a filter similar to a cupcake wrapper as produced by Mr. Coffee and Norelco, and European style appliances utilizing a conical type of filter as produced by Braun and Krups. A method for producing infusion coffee filter packs as disclosed and taught herein should be capable of operating at a relatively high manufacturing production rate.

2. Discussion of the Prior Art

One prior art manufacturing process for producing coffee filter packs involves a linear production mold wherein a first sheet of filter paper is passed successively by a filter shaping mold and a coffee filling station. A second sheet of filter paper is then applied over the first sheet and sealed thereto. This prior art approach has a commercial production capacity of only about sixty filter packs per minute, which is not a sufficiently high rate for commercial production.

SUMMARY OF THE INVENTION

A primary object of the present invention is to is provide a method for producing infusion coffee packs at a relatively high manufacturing production rate. The produced coffee filter packs in one preferred embodiment are designed to fit a large variety of coffee makers to be brewed with five cups of water per filter pack, designed to be a half of a pot for common ten cup coffee brewing machines, or to provide for brewing ten cups of coffee by utilizing two superimposed coffee filter packs.

A further object of the subject invention is the provision of a method for producing universal coffee filter packs designed to fit many different types of drip and percolator coffee makers, as well as coffee makers with spray nozzles therein. A universal design is disclosed having a total diameter of approximately five inches, which includes a one half inch wide sealed border or flange extending around the circumference of the coffee filter pack. Moreover, the coffee in the filter pack is provided with a sufficient head space, generally 50% or greater, to allow for expansion of the coffee grounds during brewing to provide proper brewing conditions therefor.

A further object of the subject invention is the provision of a method of producing universal infusion coffee filter packs in which a first strip of filter paper is placed adjacent to a mold having a cylindrical mold pocket therein. The strip of filter paper is then caused to conform to the cylindrical mold pocket, as by stretching by a mechanical tamper or a vacuum applied to the mold pocket. This operation causes the surface area of the first filter paper to increase by at least 3% relative to its surface area prior to the conforming step. The presence of the increased surface area in combination with the one half inch flange is significant as it results in a brewed coffee having an increase in soluble solids extraction and a decrease in the standard deviation of soluble solids extraction. A measured quantity of ground coffee is then deposited into the mold pocket over the stretched and conformed filter paper. A second substantially flat strip of filter paper is then placed over the first strip of filter paper and the ground coffee in the mold pocket. The first and second strips of filter paper are then sealed together, as by heat sealing, in the sealed border or flange extending around the coffee filled mold pocket. An important feature of the cylindrical mold pocket is that it have a substantially square shoulder around the top edge of the mold to force a sufficient stretching of the first strip of filter paper to provide a sufficiently large and deep mold pocket to provide a sufficient volume for the ground coffee and also for its swelling and enlargement during the brewing process.

The first strip of filter paper can comprise a stretch filter paper or a creped stretch filter paper having an elongation factor without tearing in excess of 7% to enable it to conform to the circular mold pocket without tearing. The second strip of filter paper need not stretch like the first, but could also be stretch filter paper or a creped stretch filter paper to simplify supplies of paper. The first and second strips of filter paper preferably comprise base filter paper having a polypropylene or polyethylene plasticizer applied to one side thereof and absorbed and impregnated into the base filter paper to enable the first and second strips of filter paper to be heat sealed together. This is preferably accomplished by utilizing a heated annular press around the circular mold pocket to press and heat seal the plasticizer sides of first and second strips of filter paper together in the half inch flange area around the circular mold pocket.

BRIEF DESCRIPTION OF THE DRAWINGS

The foregoing objects and advantages of the present invention for a method for producing infusion coffee filter packs may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

There are a number of factors affecting the performance of coffee filter packs as measured by soluble solids extraction, brew consistency, brew volume, brew time, and physical behavior. Variables evaluated in the development of an optimized coffee filter pack include grind, paper type, paper stretch, the presence of a flange, headspace, and the type of brewing appliance or pot.

Two very important measures of performance are soluble solids extraction and extraction consistency. The type of brewing appliance was found to be a major factor both alone and in interaction with other variables. The results indicate that paper, grind, and flange had the greatest impact on soluble solids extraction. Brew consistency was most affected by flange and paper. By optimizing these factors, an optimum design and configuration for coffee filter pouches has been developed.

The following Table of Contents lists the divisions and subdivisions of technical areas and discussions herein.

Results and Discussion

A. Independent Variables
1. Pot Performance
2. Pouched Coffee vs Loose Coffee
3. Polyethylene vs Polypropylene Paper
4. Preparation level 5 and 10 cup
B. Dependent Variables
1. Soluble Solids Extraction
   a. Stretch of Paper and Interactions
   b. Grind and Interactions
   c. Flange Interactions
   d. Headspace
2. Brew Consistency
   a. Flange and Interactions
   b. Stretch of Paper Interactions
   c. Flange and Stretch Interactions
3. Brew Time Conclusions Technical
A. Variables
1. Coffee
2. Grind
3. Filter Papers
4. Flange
5. Headspace
B. Pouch manufacture
C. Coffee Brewers, Brew technique, and Analysis The development of an optimized coffee filter pack resulted from the definition of the key parameters, relationships, and interactions affecting the performance of coffee filter pouches, to optimize their design. In an effort to utilize objective measures of performance, the development concentrated on extracted soluble solids, brew consistency, brew volume, and brew time as points of comparison. Flavor was monitored to identify abnormal brews.

RESULTS AND DISCUSSION

A. Independent Variables

1. Appliance or Pot Performance

The following discussion is based on experiments one to six described in detail hereinbelow.

The amount of extracted soluble solids did not vary significantly (95% statistical confidence level) from pot to pot for any variant in experiment #2 over 144 observations. In other experiments, where there were variations, they were below the taste threshold as confirmed by a sensory panel. To simulate consumer behavior, brews were prepared according to recipes specific to each pot type and based on the pot line.

The appliance type also affected brew volume. From 87 to 89% of the water added to the Mr. Coffee pot was returned as brew. All other pots tested returned 90–94% of the added water. The water that was lost was absorbed into the coffee bed or filter paper.

2. Pouched Coffee vs Loose Coffee

Figure 7:
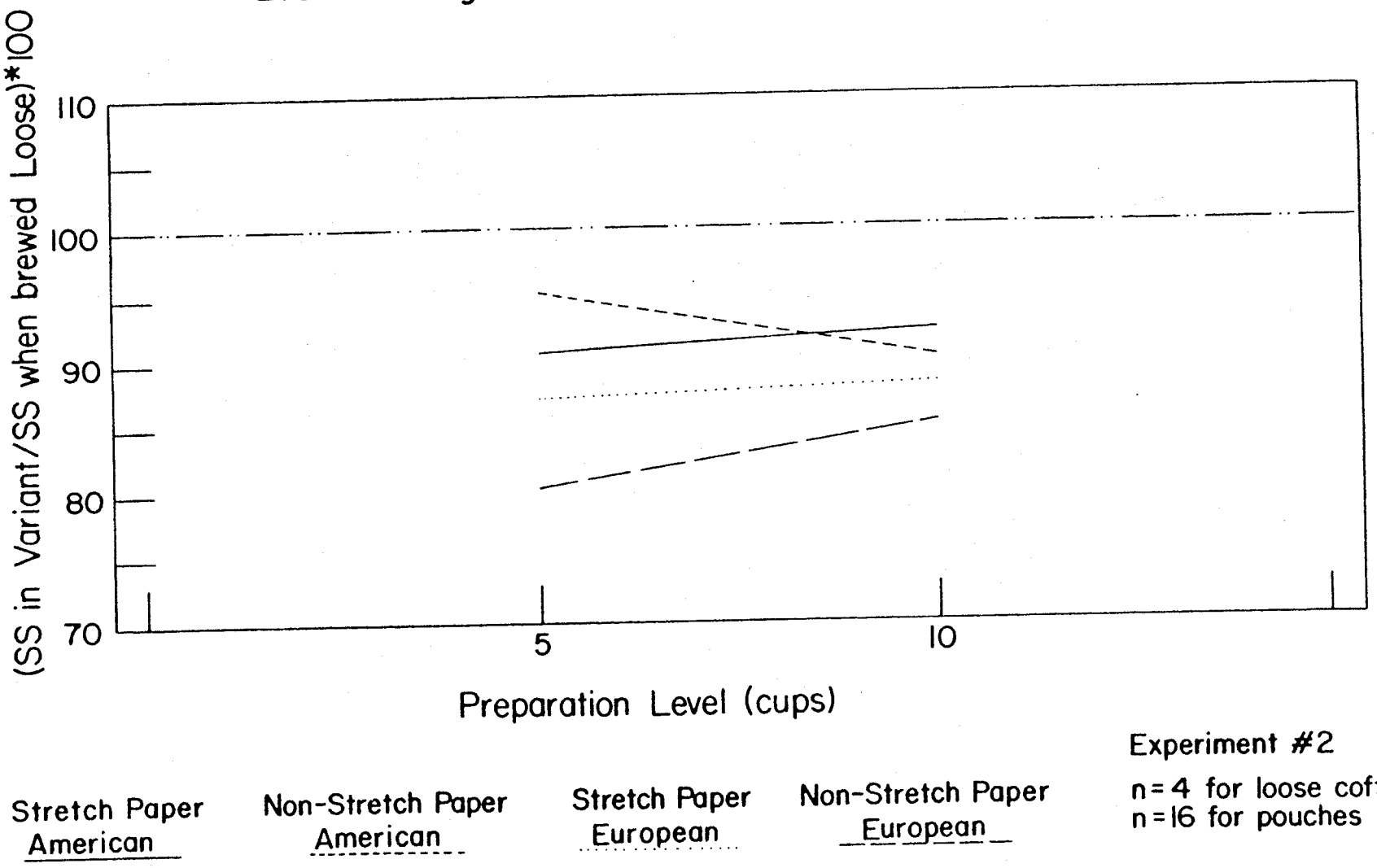
FIG. 7 illustrates four plots of data on coffee soluble solids extractions, on the performance of American style appliances with both stretch and nonstretch filter paper infusion coffee packs, and on the performance of European style appliances with both stretch and nonstretch filter paper infusion coffee packs.

Coffee brewed in stretch coffee filter packs in either style of pot or recipe level performed similarly, producing approximately 10% less solids than coffee brewed loose (FIG. 7). When coffee was brewed in European style pots, the stretch paper yielded 19% more solids than did the nonstretch paper. This was especially true at the 5 cup recipe where there was a 22% increase in extraction with the stretch paper. This difference may be attributed to the fact that the filters provided with the European brewers were cone shaped and so completely filled the brew basket.

The nonstretch pouches could not physically accomplish this and so caused a reduction in the amount of solids extracted. In the European pots, the stretch pouches performed much better than the nonstretch pouches, because the stretch feature allowed the bottom of the pouch to partially conform to the cone shape and roughly approximate the filters supplied with the brewer. The stretch of the paper was not a significant factor in the American style pots.

3. Polyethylene vs Polypropylene Paper

The majority of the experiments were performed with paper containing a polyethylene sealing agent, but experimental data showed that the filter papers with polyethylene and polypropylene sealing agents behaved equivalently by all measures as shown in Table 1. Subsequently, the polypropylene paper was used to manufacture filter packs because of a reduction in tearing with polypropylene paper.

4. Preparation Level: 5 and 10 cup

Pots brewed at the two recipe levels performed similarly both in terms of brew volume and soluble solids. The five cup preparation yielded a brew with 0.87% solids (n=186, wherein n is the number of data samples) and ten cup brews yielded 0.85% solids (n=195). All recipe levels are merged to best cover the range of consumer behavior unless noted otherwise herein.

B. Dependent Variables

1. Soluble Solids Extraction

There were three major variables affecting the amount of soluble solids extracted from a filter pouch. In order of importance they were paper, grind, and flange. Headspace was also a significant factor, as was the type of brewing appliance, which when combined with these four variables formed significant interactions.

Each of these variables and their effect on solids extraction are discussed in the following section.

a. Stretch of Paper and Interactions

Stretch paper improved the extraction of soluble solids in all experiments. The interaction between appliance type and paper was an even stronger factor.

In Experiment 5, the paper effect was significant at a statistical confidence level of 95%, and the paper and appliance type relationship was significant at a confidence level of 98%.

| | % Soluble Solids Extracted | | |
|---|---|---|---|
| | All Appliances | American style | European style |
| Stretch | 0.90 | 0.88 | 0.92 |
| Nonstretch | 0.80 | 0.84 | 0.76 |
| # of Observations | 12 | 6 | 6 |
| % Improvement | 13 | 5 | 21 |

This improvement in extraction may be attributed to the extensibility and possibly even the "softness" of the stretch paper i.e., the stretch paper allows the coffee to expand and conform to the conical shape of the European pots and so works optimally with that design as compared with nonstretch paper.

A second possible hypothesis for the improvement in solids extraction with stretch paper is that the stretch polyethylene paper wetted much faster (3.4 second) than did the nonstretch polyethylene paper which required 15.5 seconds. This is likely due to the higher surface area of the creped stretch paper, which might cause a wicking action quickly bringing hot water in contact with the coffee bed and so improving extraction.

Figure 8:
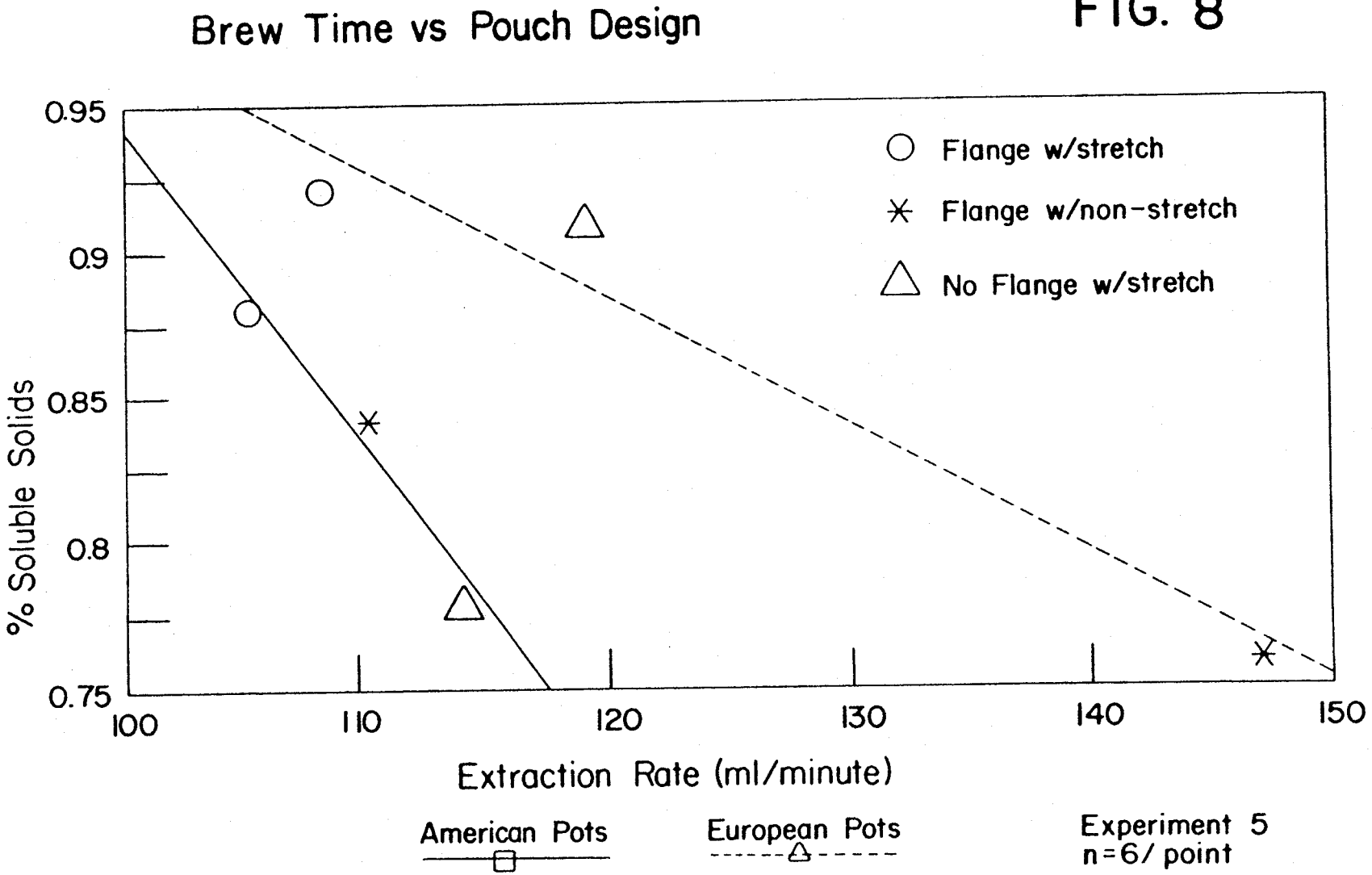
FIG. 8 illustrates two plots of data on percent soluble solids extraction, on the performance of American style appliances with coffee infusion packs with flanges and formed of both stretch and nonstretch filter paper coffee, and with no flange and formed of stretch filter paper, and on the performance of European style appliances with coffee infusion packs with flanges and formed of both stretch and nonstretch filter, and with no flange and formed of stretch filter paper.

The final hypothesis involves brew time which was longer for stretch paper than for nonstretch paper in experiment 5 (FIG. 8). This slowing of the brewing process would increase the water and coffee contact resulting in improved extraction.

b. Grind and Interactions

It was no surprise that the fine grind (583 xbar-average coffee ground size in microns) yielded 5% more extracted solids than did the coarser grind (704 xbar). The data was interesting on the relationship between pot type, paper, and grind, which in experiment #2 was significant at a 94% statistical confidence level. When comparing the fine and coarse grinds, pouches made of stretch paper and brewed in European type pots showed the largest improvement in solids extraction. Due to the extensibility of the paper, the pouch is better able to mechanically conform to the conically shaped basket and so takes advantage of the yield increase possible with the finer grind and European pot design. It is noted that there is a balance between the size of the grounds and the porosity of the filter paper, which should not become plugged with the selected size grounds. Generally, a coffee grind range of between 300 and 750 xbar is preferred.

| | | |
|---|---|---|
| Most | 13% | European pot with stretch paper |
| Improvement with change | 9% | European pot with Nonstretch paper |
| from Coarse to Fine | 4%* | American pot with stretch paper |
| Least | −4%* | American pot with Nonstretch paper |

note:
*not statistical significant c. Flange Interactions

The flange is a lip that extends from the edge of the pouch beginning where the two plys of paper are sealed. The normal flange was ½ inch. Flangeless pouches had a maximum of ⅛ inch overhang.

When the data from Experiment #5 was analyzed by appliance or pot type, a correlation significant at a 95 confidence level was found between flange, appliance type, and soluble solids extracted. The flanged pouches brewed in American style pots had 13% more solids extracted from their contents than did the non flanged pouches.

| | % Soluble Solids Extracted | |
|---|---|---|
| | American style Mean | European style Mean |
| Flange | 0.88 | 0.92 |
| No Flange | 0.78 | 0.91 |
| # of Observations | 6 | 6 |
| % Improvement | 13 | None |

No correlation was observed between the flanged design and soluble solids extraction in Experiment 2.

d. Headspace

Headspace is the amount of void volume inside a filter pouch. Different headspaces were achieved by varying the amount of coffee added to a fixed pouch size. The high headspace (50%) pouches contained 23.5 grams of coffee. The low headspace (25%) pouches contained 35 grams.

Two experiments were performed to examine the effect of headspace on pouch performance. The first held the water constant and varied the headspace to two levels, 25% and 50%. The second experiment varied both the water and the headspace proportionally.

In the first study, proportionally more solids were extracted from the high headspace pouches than the low headspace ones. This was probably due to the high water to coffee ratio which resulted in increased washing of the coffee bed and so increased extraction.

Figure 9:
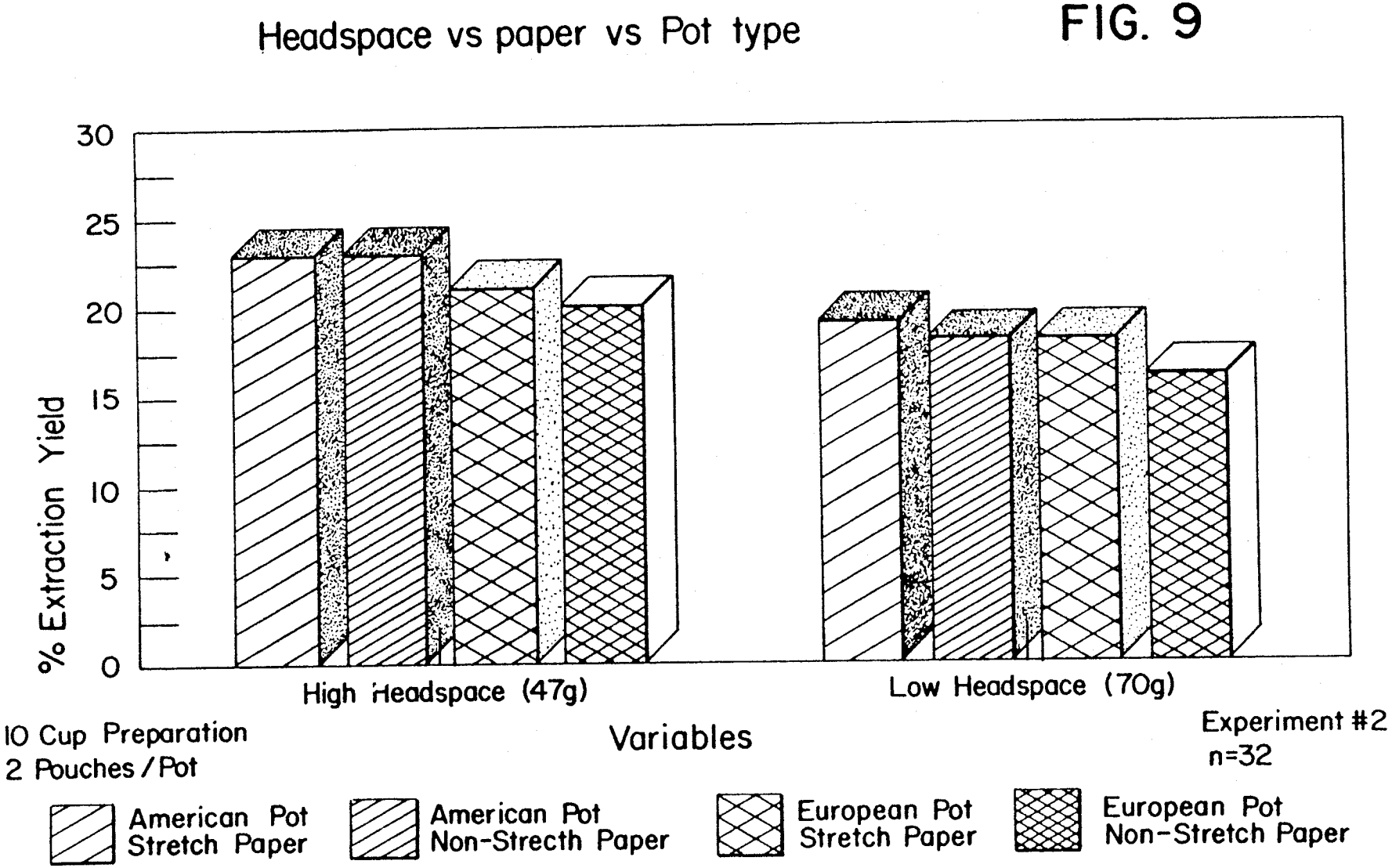
FIG. 9 illustrates eight plots of data on the percent extraction yield as a function of both high headspace and low space, classified as to the performance of American style appliances with coffee infusion packs of both stretch and nonstretch filter paper, and also on the performance of European style appliances with coffee infusion packs of both stretch and nonstretch filter paper.

Low headspace pouches brewed in European type pots produced proportionally less soluble solids than any other combination of pouch and pot. A synergy was also demonstrated between pot, paper, and headspace. For example, a comparison of pouches brewed in European style pots and made of nonstretch vs stretch paper showed a 7% drop in extracted solids at the high headspace and 13% at the low (FIG. 9). The reduction in solids extraction is probably because the nonstretch low headspace pouch was unable to expand to accommodate the water swelled coffee e.g., containment of the wet swollen coffee bed during extraction reduced the solids extraction.

The low headspace nonstretch paper produced a lower solids level in all pots than the stretch paper. With the high headspace, only nonstretch pouches brewed in European pots showed a decline in extraction. This indicates the importance of the stretch paper in achieving an acceptable product while providing processing flexibility.

Experiment #4 removed the effect of increased washing by maintaining the water to coffee ratio. Pouches made of nonstretch paper with low headspace produced less solids than did pouches made of any other combination of headspace and paper.

| | % Soluble Solids Extracted | |
|---|---|---|
| | High Headspace (50%) | Low Headspace (25%) |
| Stretch | 0.77 | 0.77 |
| Nonstretch | 0.78 | 0.72 |
| # of Observations | 3 | 3 |
| % Difference | none | 6% |

(Norelco type appliance only)

The low headspace pouches (25%) packed in nonstretch paper actually burst during brewing approximately 5% of the time, producing an unacceptable product and allowing grounds into the brew.

Generally, a head space between 25 and 75% is desirable, and a headspace between 25 and 60% is most preferred.

2. Brew Consistency

There were two controllable variables affecting brew consistency. The effects of both variables were strongly affected by pot type. The presence of a flange was found to improve brew consistency in both types of appliances, while increasing the extensibility of the paper yielded a reduction in brew variability in European style pots.

These two variables are discussed in more detail in the following section. This section will concentrate on analysis of data from Experiment #2 because of the large sample size.

a. Flange

There was a statistically significant improvement (99% statistical confidence level) in brew consistency when pouches were manufactured with a flange. The largest impact was on the American Norelco cupcake style brewers, where standard deviations and so brew variability were reduced by as much as 50%.

| | American style Pot | | European style Pot | |
|---|---|---|---|---|
| Pouch Design | Mean | Std. Dev. | Mean | Std. Dev. |
| Flanged Design | 0.78 | 0.073 | 0.76 | 0.097 |
| No Flange | 0.77 | 0.111 | 0.76 | 0.140 |
| # of Observations | 32 | | 32 | |

Note the much larger deviations with the tests with no flange. One explanation for the improvement in brew consistency with a flange is that the flange directs the water droplets into the pouch. Without the flange, water can run down the sides of the brew basket with resultant minimal and/or variable contact with the coffee bed.

b. Paper

Pouches made of stretch paper and brewed in European style pots had less variation (90% statistical confidence level) in brew solids than did pouches made of nonstretch paper of the same design and contents. Paper extensibility had no substantial effect on brew variability in American style pots.

Variability of Soluble Solids Extraction Standard Deviation

| Paper | All Appliances Std. Dev. | American style Std. Dev. | European style Std. Dev. |
|---|---|---|---|
| Stretch | 0.097 | 0.094 | 0.101 |
| Nonstretch | 0.115 | 0.094 | 0.131 |
| # of Observations | 64 | 32 | 32 |

Paper extensibility was a less important factor in minimizing brew variability than the flange.

c. Flange and Stretch Interactions

Figure 10:
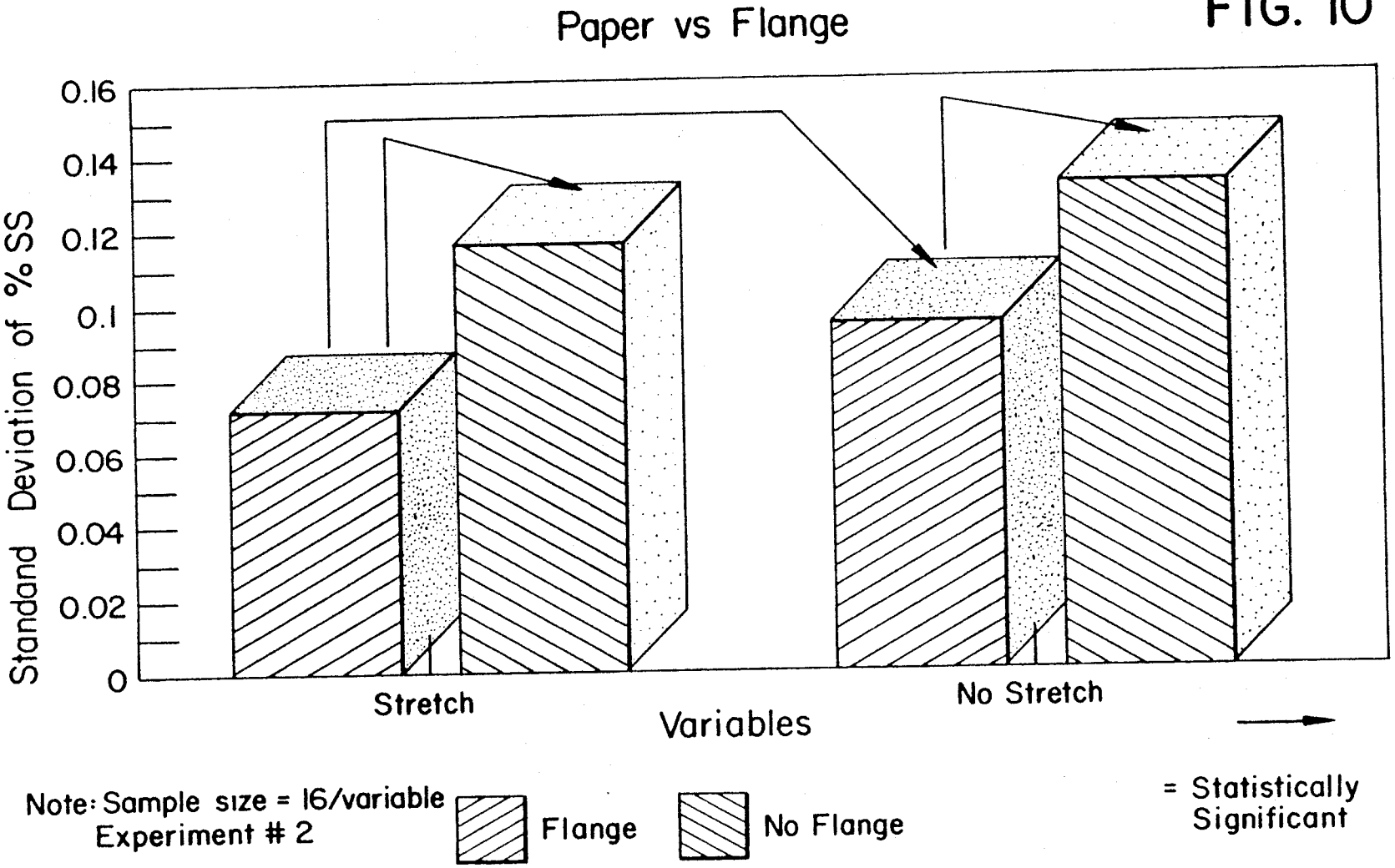
FIG. 10 illustrates four plots of data on the standard deviation of percent extraction, classified as to the performance of stretch filter paper coffee packs with and without a flange, and of nonstretch filter paper coffee packs with and without a flange.
Figure 11:
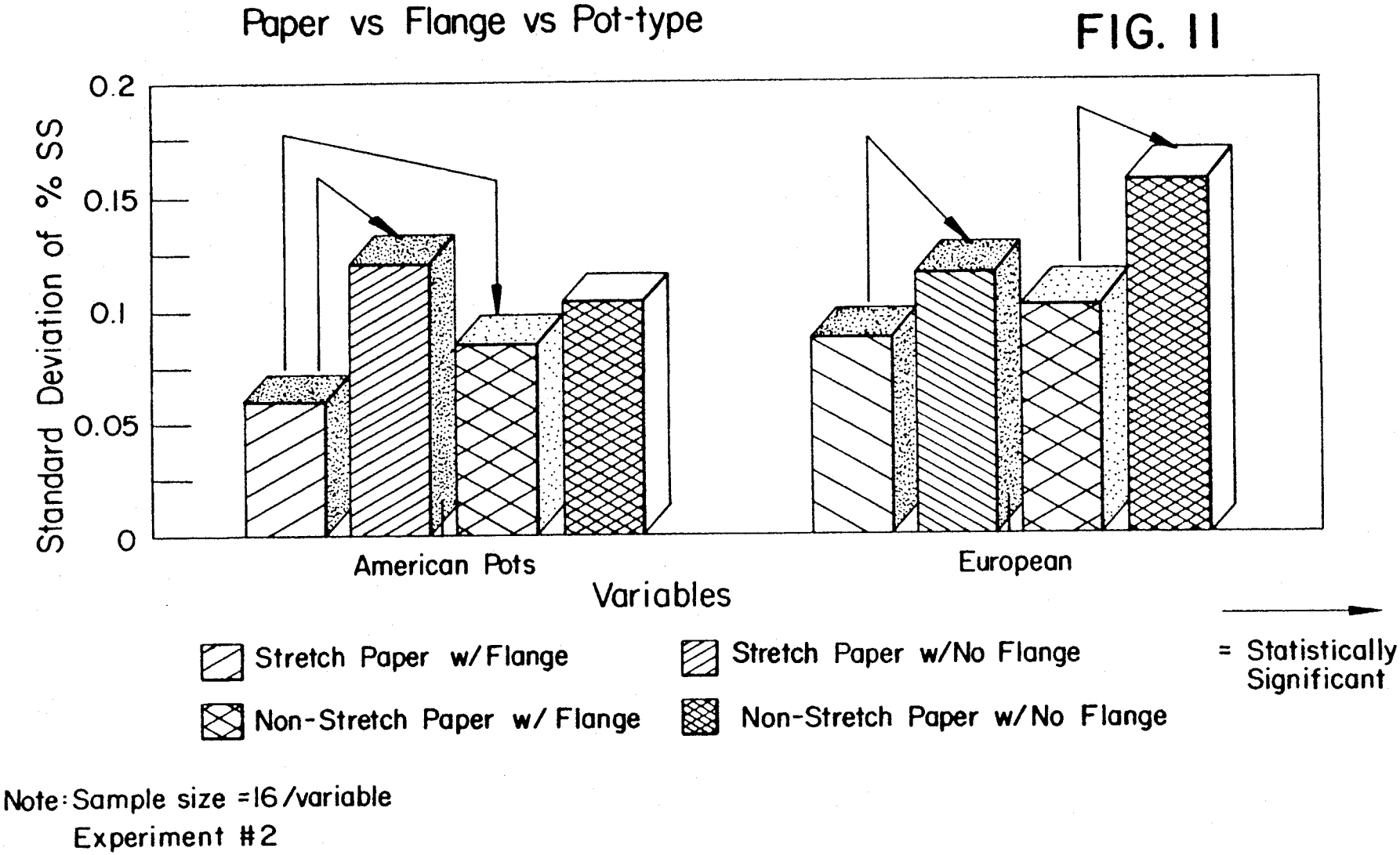
FIG. 11 illustrates eight plots of data on the standard deviation of percent extraction, classified as to the performance of American style appliances with coffee infusion packs with and without a flange, formed of both stretch filter paper and nonstretch filter paper, and on the performance of European style appliances with coffee infusion packs with and without a flange, formed of both stretch filter paper and nonstretch filter paper.

An interaction between flange and paper was observed (FIGS. 10 and 11). The flange caused the largest reduction in brew variability when pouches were made of stretch paper and brewed in an American style pot. In terms of filter packs, this points up the essential nature of the flange to achieve brew consistency since the stretch paper allows formation of the pouches without tearing.

Variability of Soluble Solids Extraction Standard Deviation

| | American style Appliance | | European style Appliance | |
|---|---|---|---|---|
| Pouch Configuration | Stretch Std. Dev. | Nonstretch Std. Dev. | Stretch Std. Dev. | Nonstretch Std. Dev. |
| Flanged design | 0.060 | 0.085 | 0.087 | 0.102 |
| No Flange | 0.121 | 0.104 | 0.116 | 0.158 |
| # of Observations | 16 | 16 | 16 | 16 |

3. Brew Time

Brew time was largely a function of the appliance type (99% statistical confidence level), with the European pots brewing their 10 cups up to 20% faster than the American pots. The Krups pots brewed the fastest of the four types, requiring under 10 minutes to brew 10 cups. the Norelco pots required 12 minutes for the same 10 cups, but they also used 18% more water. The Mr. Coffee pots had the largest variation in brew time.

Brew time vs Pot (ml/minute)

| | Braun | Krups | Mr. Coffee | Norelco |
|---|---|---|---|---|
| Extraction rate (ml/min) | 127 | 136 | 119 | 127 |
| Standard Deviation | 6.16 | 9.41 | 28.55 | 12.64 |
| Total Time (minutes) | 9.76 | 9.69 | 11.36 | 12.21 |
| # of Observations | 22 | 24 | 22 | 23 |

Paper had a measurable effect on brew time. Pouches made of nonstretch paper and prepared in European style pots brewed the fastest and had lower soluble solids than did any other combination of pot and paper.

In Experiment #5, the flanged pouches required 9% more time to brew an equivalent amount of coffee than did the nonflanged pouches (FIG. 8). The observed slowing of the brewing process provides additional support for the concept that the flange diverts the water into the pouch and off the sides of the brew basket. This is responsible for the up to 13% increase in soluble solids extracted from the flanged pouches.

Extraction, Brew Time, Flange, and Paper (n=6)

| Pouch | American style Pot | | European style Pot | |
|---|---|---|---|---|
| Configuration | Stretch | Nonstretch | Stretch | Nonstretch |
| Flanged design | | | | |
| Soluble Solids (%) | 0.88 | 0.84 | 0.92 | 0.76 |
| Time (minutes) | 13.31 | 12.74 | 11.73 | 8.58 |
| No Flange | | | | |
| Soluble Solids (%) | 0.78 | | 0.91 | |
| Time (minutes) | 12.3 | | 10.6 | |

CONCLUSIONS

In conclusion, the amount of soluble solids extracted from a filter pouch was linked to four factors, paper, grind, headspace, and flange. The extensibility of the paper appeared to be key in the ability of the pouches perform successfully in conical (European) pots, probably because it allowed them to better conform to the shape of the brew basket.

Brew consistency was largely a function of two variables, flange and paper. The flange contributed the most to brew consistency. Stretch paper was also a factor in European type appliances to a lesser degree. There was a synergy between flange and paper which contributed to brew consistency, with stretch paper and a flange yielding the most consistent brew.

In addition to the contribution of the flange to brew consistency, there was also an improvement in the mechanical performance of flanged pouches. Flangeless pouches brewed in European style pots frequently slid onto their side into the coffee baskets forming an irregular/nonreproducible coffee bed. Flanged pouches in American type pots appeared to direct water into the coffee bed and so increase extraction.

TECHNICAL SECTION

A. Variables

1. Coffee

The decaffeinated coffee used in this study was decaffeinated and roasted. A 40 pound charge of high Arabica blend was roasted to a 45 +/− 2 roast color in a 40 pound Probat roaster for just under 11 minutes. The temperature profile was 350/330° F. with a charge temperature of 400° F. and a final temperature of 360° F. The coffee was held for 30 minutes prior to grinding. The density of the roasted whole bean was 0.319 grams/cc. The moisture target was 5.2%

The caffeinated coffee was roasted under conditions similar to those used for the decaffeinated coffee. The caffeinated coffee was roasted to a 60 +/− 2 roast color and moisture of 5.2%. The roasted whole bean had a density of 0.359 grams/cc.

2. Grind

All coffee was ground, within 24 hours of roasting, on a Gump grinder with normalizer. The roast and ground coffee was packed in one pound cans under 29" vacuum for later pouching.

The decaffeinated coffee was ground to a target of 600 xbar (618 actual) and had a density of 0.340 grams/cc.

The caffeinated beans were ground to two large targets: fine (583 xbar actual) and coarse (704 xbar actual). Both grinds had a density of 0.342 grams/cc.

3. Filter Papers

The filter papers 1, 2 and 3 were manufactured by Dexter Paper Company, Windsor Locks, Conn. These papers varied both in their plasticizer/sealing agents and in the amount of stretch that had been introduced into them by creping. Creping or microcreping is a process whereby dry paper is squeezed up against a doctor blade forming small folds parallel to the blade. When the force against the blade is removed, some of the folds remain providing some degree of extensibility or stretch. Our target was 8–12% stretch in the machine direction. The fourth filter paper type used in these experiments was provided by the manufacturer of the individual appliance at the point of sale.

(1.) Nonstretch paper: Dexter 9355 paper "NS" polyethylene pulp rayon plasticizer and cellulosic fibers (23:77)
Basis weight: 14.0 lb./2880 $ft^2$
Air permeability: 975 liters/minute/100 $cm^2$
3M treatment (lipophobic stain resistance): 0.75% by weight
Porosity: 1000 liter/minute
Formation: 85.0%
Brightness: 70.0%
pH: 6.8
Strength: Cross direction: dry = 1.34 lb./inch
Machine direction: dry = 0.67 lb./inch, wet = 0.50
Elongation: Cross direction: 4.8%, Machine direction: 4.2%
Paper moisture: 4–6.5%

(2.) Stretch paper: Dexter 9503 paper ("PES" of "S") polyethylene pulp rayon plasticizer and cellulosic fibers
Basis weight: 17.15 lb./3000 $ft^2$
Air permeability: 975 liters/minute/100 $cm^2$ -continued Strength: Cross direction: dry = 0.24 lb./inch, wet = 0.08 lbs. inch
Machine direction: dry = 0.32 lb./inch, wet = 0.17 lbs. inch
Elongation: Cross direction: 9.6%, Machine direction: 8.3%
Paper moisture: 4–6.5%
Seal profile: the strength of a seal (delamination) in lbs/inch
Seal Temperature (F.) vs lbs/inch needed to delaminate

| Degrees F. | 275 | 300 | 325 | 350 | 375 |
|---|---|---|---|---|---|
| lbs./inch | 0.23 | 0.25 | 0.28 | 0.38 | 0.47 |

(3.) Stretch paper (polypropylene): Dexter 9926 paper "PPS" polypropylene plasticizer and cellulosic fibers
Basis weight: 15.35 lb./3000 $ft^2$
Air permeability: 370 liters/minute/100 $cm^2$
Strength: Cross direction: dry = 0.24 lb./inch, wet = 0.08 lbs. inch
Machine Direction: dry = 0.32 lb./inch, wet = 0.7 lbs. inch
Ratio of machine to cross directional (dry): 51.6
Elongation: Cross direction: 12.4%, Machine direction 7.3%
Paper moisture: 4–6.5%
Seal profile: the strength of a seal (delamination) in lbs/inch
Seal Temperature (F.) vs lbs/inch needed to delaminate

| Degrees F. | 275 | 300 | 325 | 350 | 375 |
|---|---|---|---|---|---|
| lbs./inch | 0.0 | 0.41 | 1.08 | 1.20 | 0.75 |

(4.) Commercially available filter paper supplied with brewers, either conical filters or cupcake-style filters Generally, a stretch paper having an elongation factor of at least 6%, and preferably at least 8%, is preferred.

4. Flange

The flange is the area extending from the edge of the pouch where the two plys of paper meet and are sealed. Pouches were manufactured in two ways, with a ½ inch flange, and flangeless (with a maximum of ⅛ inch).

5. Headspace

The coffee filter packs or pouches were manufactured with low (25%) and high (50%) headspaces. Headspace was controlled by keeping everything constant but the grams of coffee inside the pouch. The low headspace pouches contained 35 grams of coffee, the high headspace held 23.5 grams.

B. Pouch Manufacture

The pouches were made with hand-cut Dexter paper. The pouches were hand filled with the specified amount of coffee and sealed between a piston driven heated sealing head and a mold having a cylindrical mold cavity therein, similar to the arrangement of FIG. 1. The cylindrical mold cavity had a diameter of four inches and a depth of 3/16" for the standard 23.5 gram pouches and 5/16" for the 35 gram pouches. The electrically heated sealing head was maintained at 375° F. for the polyethylene filter paper and 450° F. for the polypropylene filter paper. A force of 20–25 psig was exerted onto the flange sealing area for 10.5 seconds. A rate of production of 600–650 pouches/day was achieved under these operating conditions. Once completed, ten pouches were packed in a Mylar Special Delivery bag which was gas flushed ($CO_2$), sealed with a Koch sealer, and kept frozen until the pouches were brewed.

C. Coffee Brewers, Brew technique, and Analysis

Two main types of electric drip coffee appliances or pots were used for these experiments. The American style flat bottomed cupcake-style filter and pot was represented by the Mr. Coffee (CM10 and 1DS-10 ) and the Norelco (C284e). The European style conical filter and basket brewer was represented by the Krups (164-70-51) and the Braun (KF80 and M4063).

Coffee was brewed at both a 5 and 10 cup recipe level using one or two filter pouches accordingly. The amount of water put into the pots was based on the pot line according to the manufacturer's specifications. Once the pot line was measured, that amount of water was measured in a graduate and used for all subsequent brews on that pot type.

The specific pot used and the order of brew were randomized. Tests were replicated a minimum of twice with much of the brewing done in triplicate. The final brew temperature was monitored to assure that the pots were performing normally and not operating at an unusually low or high temperature invalidating the brew data. Flavor was also monitored looking for brew abnormalities.

Depending on the experiment, the brew volume, time, and final temperature were measured along with the soluble solids extracted (hydrometer).

Quality Assurance method #8C 12/30/70 using a Rascher and Betzoid hydrometer was used to measure soluble solids in all brews. A comparison between the hydrometer versus sand solids confirmed that the two methods yielded equivalent results at a 95% statistical confidence level.

The repeatability of brew data was extremely high. In 22 10 cup brews with Norelco pots, an average soluble solids extraction of 0.77% with a standard deviation of only 0.037 was measured. All the analyses of variance showed significantly more intervariant variation then intravariation.

EXPERIMENTS

Experiment 1: Evaluation of the performance of filter packs with decaffeinated coffee Number of measurements=48, Number of replications=3

Roasted decaffeinated coffee was brewed in four brands of appliances pots at two preparation levels in pouches made of either stretch of nonstretch paper.

Experiment 2: Detailed performance study of filter packs evaluating six variables Number of measurements=400, Number of replications=2

Twenty four variants were made with Richheimer roasted caffeinated coffee brewed in four brands of pots at two preparation levels in duplicate. The following variables were evaluated; grind, flange, stretch paper, headspace. A control, brewed loose in filters, was also tested.

Experiment 3: Quick evaluation of polypropylene paper

Number of measurements=5, Number of replications=5

Pouches of stretch polypropylene filled with pilot plant roasted coffee equivalent to the coffee used for the other caffeinated work was prepared at the ten cup level in the Norelco Brewer five times.

Experiment 4: Effect on varying headspace - constant recipe Number of measurements=24, Number of replications=3

Pilot plant roasted coffee packed at two headspace levels (23.5 or 35 grams) in stretch and nonstretch paper was brewed at a water addition level proportional to the grams of coffee in the pouch instead of the manufacturer's recommendation (pot line).

Experiment 5: Study of flange, paper, and engineered grind distribution

Number of measurements=48, Number of replications=3

Pilot plant roasted coffee was pouched as one of the following four variants, stretch paper with flange (600 xbar), stretch paper without flange (600 xbar), Nonstretch paper with flange (600 xbar), and stretch paper with flange and engineered grind distribution. This grind distribution was prepared from 600 xbar coffee that was screened through a 70 mesh USA screen to remove all particles smaller than 212 microns.

Experiment 6: Polypropylene performance study

Number of measurements=16, Number of replications=2

Flanged, stretch polypropylene pouches were filled with pilot plant roasted caffeinated coffee at 600 xbar and brewed at the five and ten cup recipe on all four standard pots.

TABLE 1

| | Paper Performance | | | |
|---|---|---|---|---|
| | % Soluble Solids | Brew Time (minutes) | Brew Volume (ml) | % Yield (Solids*Volume)/ 47 g |
| | Polyethylene (experiment #2) | | | |
| Norelco | 0.74 | 12 | 1,538 | 24 |
| Mr Coffee | 0.88 | 11 | 1,299 | 24 |
| Braun | 0.81 | 10 | 1,228 | 21 |
| Krups | 0.79 | 10 | 1,300 | 22 |
| | Polypropylene (experiment #6) | | | |
| Norelco | 0.81 | 14 | 1,510 | 26 |
| Mr Coffee | 0.77 | 10 | 1,258 | 21 |
| Braun | 0.87 | 12 | 1,215 | 22 |
| Krups | 0.78 | 10 | 1,235 | 20 |

10 Cup Preparation - 2 Pouches/Pot - 23.5 Grams/Pouch

Figure 1:
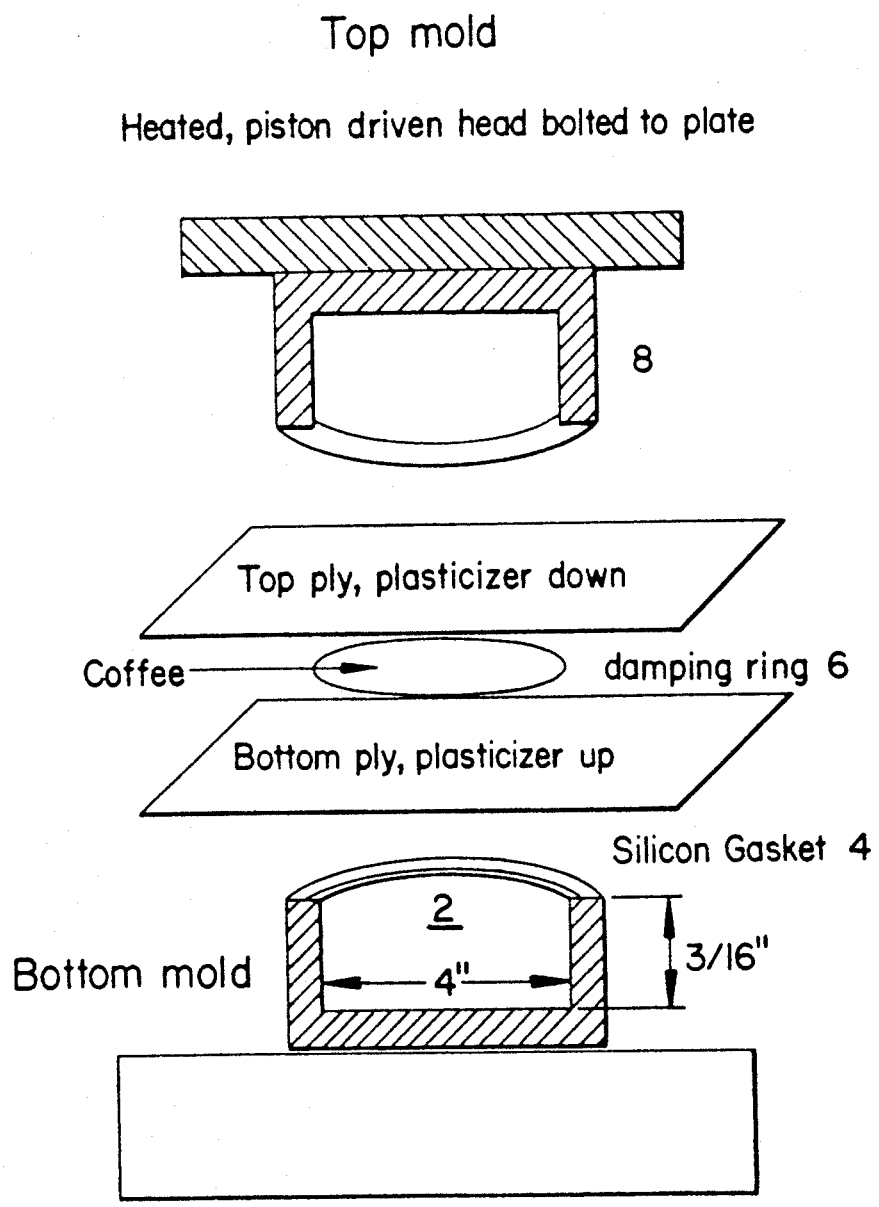
FIG. 1 is a schematic view of an embodiment of a mold which was used to produce improved infusion coffee filter packs as described and tested herein.

Referring to the drawings in detail, FIG. 1 illustrates a schematic arrangement of a mold used for producing improved infusion coffee filter packs as described and tested herein. The mold arrangement includes a bottom mold 2 having a silicon gasket 4 placed on top thereof around the cylindrical mold pocket, a damping ring 6 for pressing the bottom filter ply into the mold pocket, and a heated top mold 8 driven by a piston to press the top and bottom molds, with the top and bottom plys therebetween, to seal the top and bottom plys together.

The coffee filter packs or pouches as described and tested herein were made in a mold as illustrated in FIG. 1 in a procedure in which a bottom ply of filter paper is placed, plasticizer side up, above the bottom mold. The surface area of the bottom ply is then expanded or increased by causing the bottom ply to conform to the bottom mold. In the procedure, the bottom ply was caused to conform to the bottom mold by placing a circular ring (having a diameter slightly less than the diameter of the bottom mold) over the bottom ply and mechanically pushing or tamping the bottom ply into the bottom mold with the circular ring, then by pouring into the bottom mold pocket the measured amount of ground coffee, 35 grams for a standard five cup pack, then removing the ring, and placing the top ply, plasticizer down, over the bottom mold pocket and extending over the bottom ply in areas surrounding the mold pocket, and then by actuating the piston driven and heated top mold to press down and heat seal together the top and bottom plys. The resultant product was then trimmed, as by die cutting, to form an infusion coffee filter pack having a five inch outer diameter, with a central four inch diameter pouch, having a one half inch flange area extending therearound.

In the particular described procedure, the area of the top filter ply, which is substantially flat, is $\pi.(5'')^2=78.54$ inches square.

The bottom filter ply had its area increased by the cylindrical band extending around the bottom mold, or by $\pi$. d . h (height of mold pocket), or $4''3/16''=2.36$ inches square. Thus, the total area of the bottom ply is now 80.9 square inches, for an increase of 3%. For the larger 5/16 inch deep mold, the increase in area is $\pi$. 4". 5/16"=3.93%.

Figure 2:
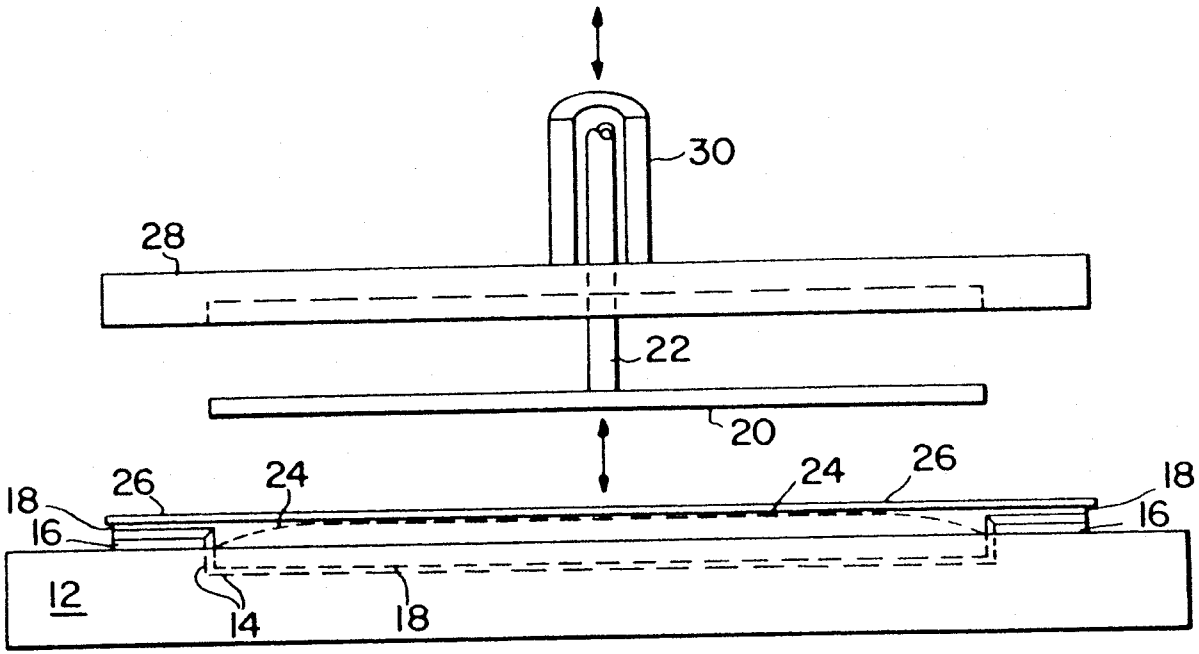
FIG. 2 is a schematic view of an exemplary embodiment of a mold which can be utilized in the method of producing infusion coffee filter packs pursuant to the present invention.

FIG. 2 illustrates a second embodiment of a mold similar in some respects to that of FIG. 1 in which a mold body 12 defines a cylindrical mold cavity 14 therein, having dimensions of 4 inches diameter by 3/16 inches depth (or 5/16 inch as noted herein). A bottom piece of filter paper 18 is placed over the mold cavity 14. The filter paper 18 is then caused to stretch and conform to the inner surface of the mold cavity, as by a mechanical tamper 20, or alternatively by a vacuum applied to the mold cavity. The tamper 20 can be a ring or a disc or any suitable shape, and can be positioned vertically by a vertically reciprocating shaft 22. A metered amount of coffee 24 is then deposited over the stretched filter paper 18 in the mold cavity. A top piece of filter paper 26 is then placed over the bottom filter paper, with the coffee in the pouch formed therebetween. An electrically heated annular sealing head 28, driven as by a vertically driven shaft 30, is then pressed over the first and second sheets of filter paper in the ½ inch margin area around the mold cavity, and a force is exerted on the heated sealing head for a given period of time, pressing and sealing together the first and second sheets of filter paper around the ½ inch margin area 32. The completed infusion coffee filter pack 34 is then removed and trimmed to a five inch diameter as by die cutting, and the process repeated.

In an automated version of the production method of FIG. 1, the mold 12 could be connected in an endless chain configuration, with each mold having the bottom filter paper placed thereover in a first station, at which the tamper 20 or a vacuum applied to the mold cavity causes the filter paper to stretch and conform to the mold cavity. A metered amount of coffee is then deposited over the bottom filter paper in the mold cavity in a fill station, and the top filter paper is then placed thereover, and a heated sealing head 28 presses and heat seals together the two sheets of filter paper in a sealing station, and the infusion coffee filter pack is then removed from the mold cavity and trimmed to a five inch diameter. The metered amount of ground coffee can be deposited by a standard metering and depositing machine.

Figure 3:
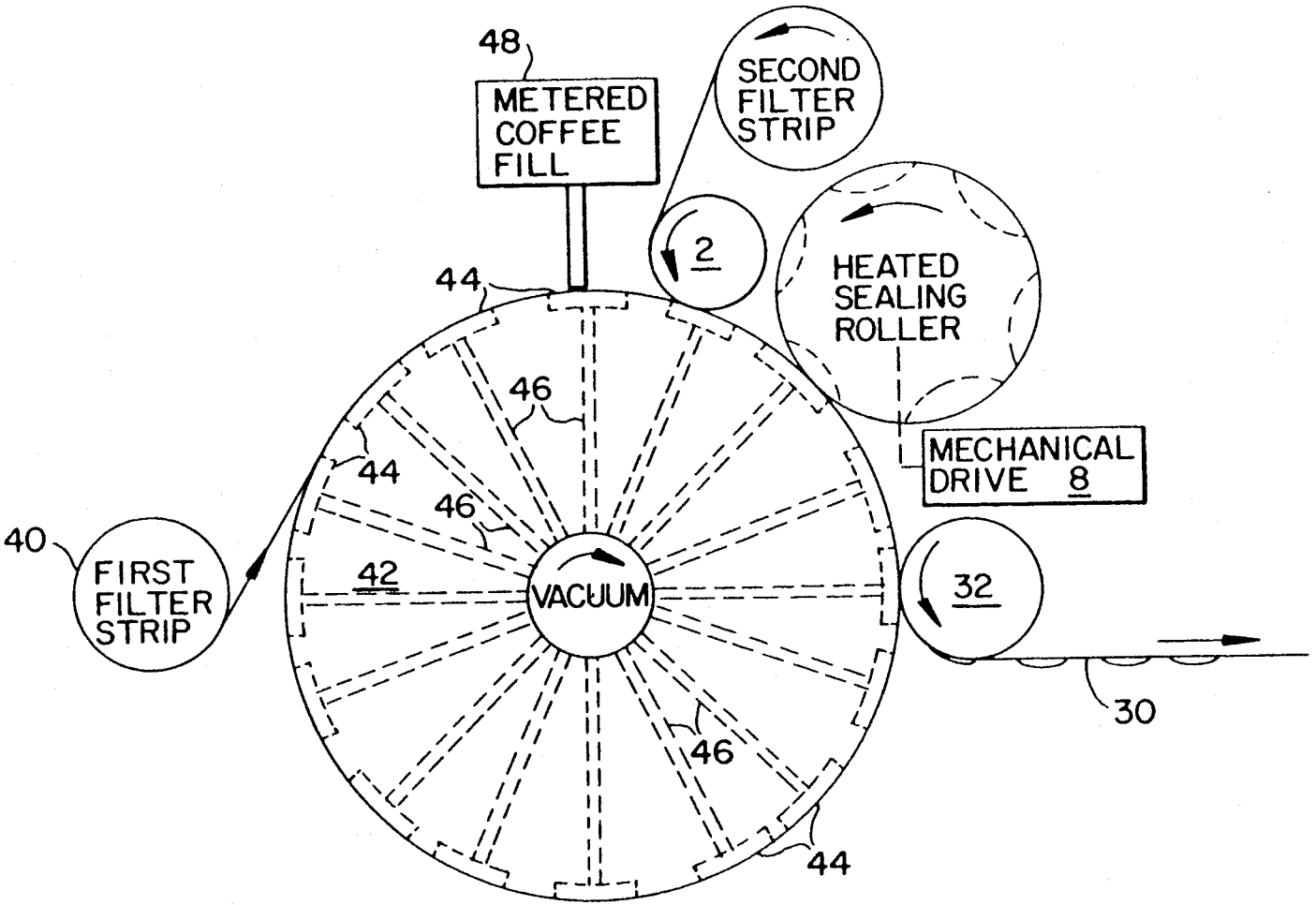
FIG. 3 is a schematic view of an exemplary embodiment of a rotary mold and packaging machine which can be utilized to produce infusion coffee filter packs pursuant to the present invention.
Figure 4:
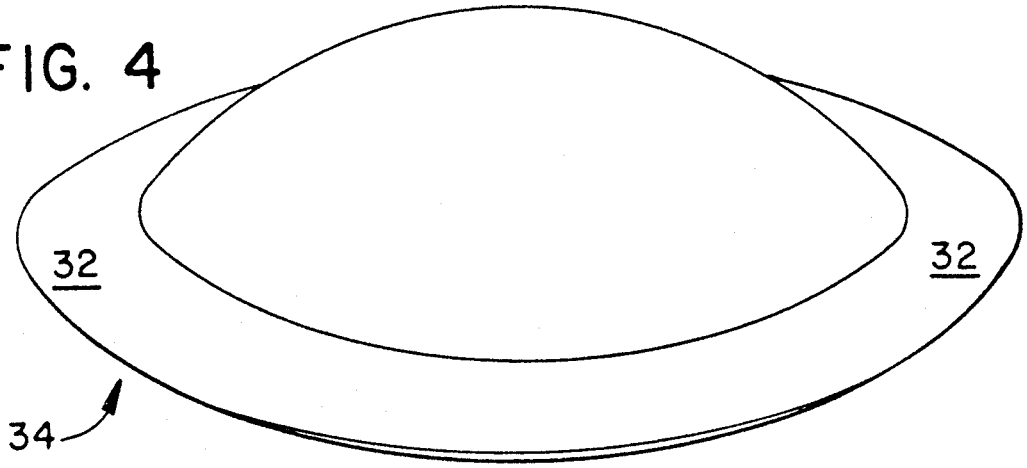
FIG. 4 is a front perspective view of a full size embodiment of a coffee infusion pack produced pursuant to the method of the present invention.
Figure 5:
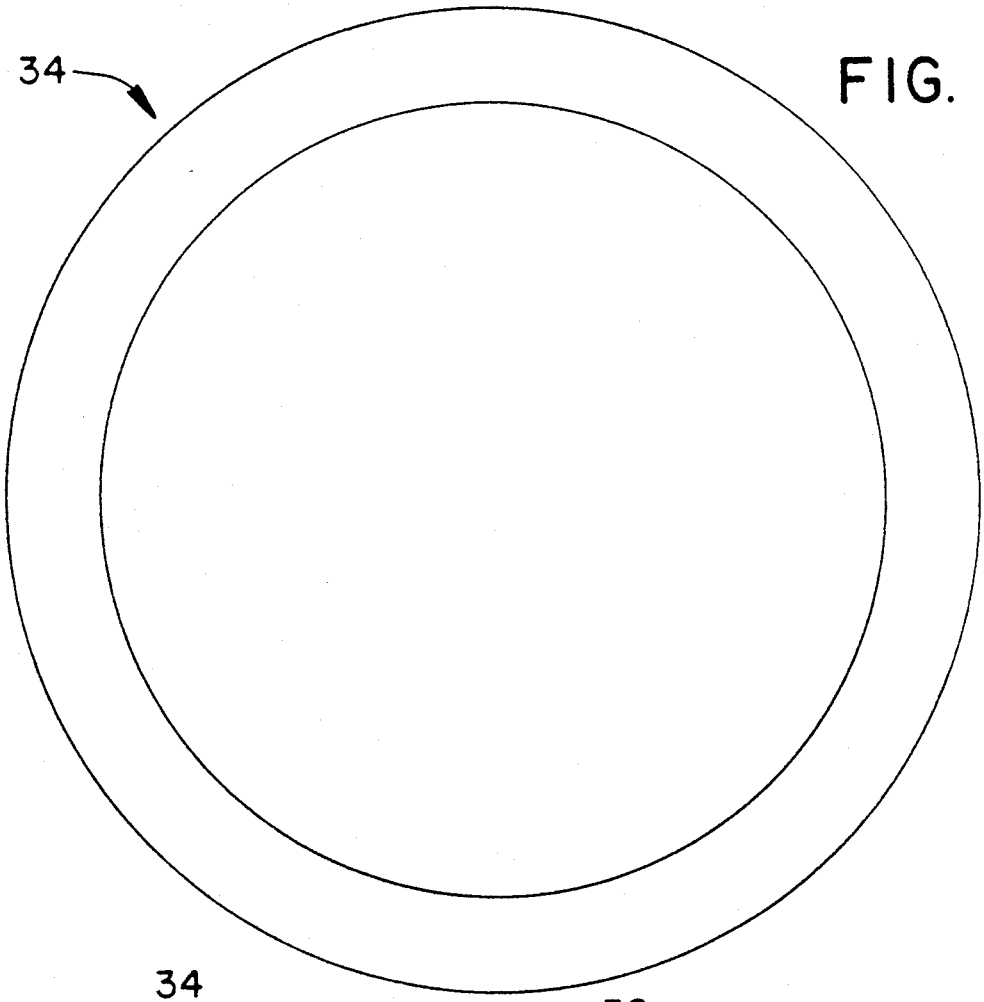
FIG. 5 is a top plan view of the infusion coffee filter pack of FIG. 4.
Figure 6:
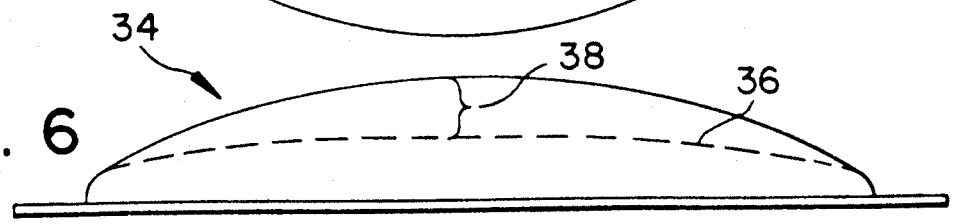
FIG. 6 is a side elevational view of the infusion coffee filter pack of FIGS. 4 and 5.

FIG. 3 illustrates a schematic arrangement of a rotary mold and packaging arrangement, as might be used in a preferred commercial embodiment in which a first strip of filter paper is supplied from a supply roll 40 onto the cylindrical side surface of a rotating cylindrical mold 42. The rotary mold 42 preferably comprises a series of circumferentially spaced cylindrical mold pockets 44, each of which communicates with a central vacuum by a vacuum passageway 46. The applied vacuum causes the first strip of filter paper to stretch and conform to the mold pockets 44. At a location near the top of the cylindrical mode 42 when the mold pockets are substantially horizontal and level, a metered amount of ground coffee is deposited therein by a metering and depositing machine 18. A second filter strip is then supplied by a roll 50 around an idler roller 52 to apply a second filter strip over the first filter strip and the coffee filled pockets therein. The first and second filter strips are preferably formed from a polyethylene empregnated base filter paper to provide for heat sealing together by a heated sealing roller 54, which heats and presses the two sheets of filter paper together at all locations except those of the coffee pockets. The heated sealing roller 54 is provided with a series of circumferentially spaced cut-outs 56 therein in correspondence with the circumferentially spaced mold pockets 44 of the cylindrical mold, and accordingly the heated sealing roller 54 is driven in synchronism with the cylindrical mold 42 by a common mechanical drive 58. The strip 60 of sealed spaced coffee packs is then withdrawn from the rotating mold 42 over an output idler roller 62. The output strip 60 is then cut and trimmed by a die cutting machine to form individual infusion coffee packs 64. A suitable rotary die packaging machine similar to that of FIG. 3 is commercially available from the Cloud Manufacturing Co., which produced and supplies packaging equipment for the food industry, and sells commercially rotary die packaging machines.

The first and second filter strips are preferably filter paper coated with polypropylene, or alternatively polyethylene, plasticizer sealer to provide for heat sealing together thereof. Moreover, the first and second pieces of filter paper can also be directed to the molds from continuous strip supplies thereof, as from supply rollers, and the process continued as described, forming an output strip of joined infusion coffee packs, which could then be cut and trimmed by a die cutting machine to form the individual infusion coffee packs 34.

One object of the present invention is to provide a method for commercially producing universally fitting, infusion coffee filter packs having a central coffee pocket diameter of four inches, with a one half inch sealing margin therearound, producing a total diameter of five inches, presents an appropriately sized infusion coffee pack for a universal fit to many different types of coffeemakers. Moreover, a brewing portion of five cups of water presents a convenient and marketable size, fitting most coffee makers. A rather steep edge to the coffee pocket is required to provide an ideal volume of coffee grounds, together with a 0% expansion space, for a five cup portion in a coffee central pocket diameter of four inches. In view thereof, the cylindrical mold cavity must have a sharp, substantially ninety degree edge, which requires that the first strip of filter paper be able to stretch and yield a substantial amount to enable it to conform without tearing to the sharp contour of the circular top edge of the mold cavity. A creped stretch filter paper has been found to meet those requirements satisfactorily. The second strip of filter paper is applied substantially flat, and accordingly need not be stretch filter paper. However, supply stocks would be simplified by choosing the material of the second strip of filter paper to be the same as the first strip.

While several embodiments and variations of the present invention for a method for producing infusion coffee filter packs are described in detail herein, it should be apparent that the disclosure and teachings of the present invention will suggest many alternative designs to those skilled in the art.

What is claimed is:

1. A method for producing drip infusion coffee filter packs having loose ground coffee therein comprising:

a. placing a first strip of filter paper adjacent to an integral and unitary mold defining an integral and unitary cylindrical mold pocket, and causing the first strip of filter paper to stretch and conform to the integral and unitary cylindrical mold pocket while increasing the surface area of the first strip of filter paper by at least three per cent relative to its area prior to the stretching and conforming step;

b. depositing a measured quantity of loose ground coffee into the integral and unitary cylindrical mold pocket over the first strip of filter paper stretched and conformed thereto;

c. placing a second substantially flat and unstretched strip of filter paper over the first strip of filter paper and the loose ground coffee in the integral and unitary cylindrical mold pocket while providing a head space of at least 50% of the volume of the pocket between said first and second strips of filter paper to provide for expansion of the ground coffee during brewing;

d. sealing the first stretched strip of filter paper and the second flat and unstretched strip of filter paper together in a flange area having a width of substantially one half inch around the loose ground coffee deposited in the integral and unitary mold pocket; and e. trimming the filter paper around the one half inch wide flange area, wherein the presence of the one half inch flange in combination with the increased surface area of the first strip of filter paper and the provided head space results in a brewed coffee having an increase in soluble solids extraction, and also results in a decrease in the standard deviation of soluble solids extraction.

2. A method for producing drip infusion coffee filter packs having loose ground coffee therein as claimed in claim 1, said integral and unitary cylindrical mold pocket having a diameter of substantially 4".

3. A method for producing drip infusion coffee filter packs having loose ground coffee therein as claimed in claim 2, said step of depositing a measured quantity of loose ground coffee comprising depositing a measured quantity of loose ground coffee to brew coffee with five cups of water.

4. A method for producing drip infusion coffee filter packs having loose ground coffee therein as claimed in claim 1, in which the increase in soluble solids extraction is at least 5% compared to a coffee filter pack having first and second pieces of filter paper having equal surface area.

5. A method for producing drip infusion coffee filter packs having loose ground coffee therein as claimed in claim 1, said step of placing a first strip of filter paper comprising placing a first strip of stretch filter paper having an elongation factor without tearing in excess of substantially 7% to enable to stretch and conform to the integral and unitary cylindrical mold pocket without tearing.

6. A method for producing drip infusion coffee filter packs having loose ground coffee therein as claimed in claim 5, said step of placing a second strip of filter paper comprising placing a second strip of stretch filter paper of the same type as said first strip of filter paper.

7. A method for producing drip infusion coffee filter packs having loose ground coffee therein as claimed in claim 1, said step of placing a first and second strips of filter paper comprising placing a first and second strips of polypropylene or polyethylene treated filter paper to enable the first and second strips of filter paper to be heat sealed together.

8. A method for producing drip infusion coffee filter packs having loose ground coffee therein as claimed in claim 7, said sealing step comprising pressing, with a heated annular press having a circular cut out in correspondence with the integral and unitary cylindrical mold pocket, the first stretched and the second flat and unstretched strips of filter paper together in said flange area around the integral and unitary cylindrical mold pocket.

9. A method for producing drip infusion coffee filter packs having loose ground coffee therein as claimed in claim 7, said integral and unitary cylindrical mold pocket defining a substantially square shoulder around the top edge of the integral and unitary cylindrical mold pocket.

10. A method for producing drip infusion coffee filter packs having loose ground coffee therein as claimed in claim 7, wherein said step of providing a head space comprises providing a head space of substantially 50% of the volume of the pocket between said first and second strips of filter paper.

* * * * *